US007358921B2

(12) United States Patent
Snyder et al.

(10) Patent No.: US 7,358,921 B2
(45) Date of Patent: Apr. 15, 2008

(54) DUAL POLARIZATION ANTENNA AND ASSOCIATED METHODS

(75) Inventors: Chris Snyder, Melbourne, FL (US); Griffin K. Gothard, Satellite Beach, FL (US); Jay Kralovec, Viera, FL (US)

(73) Assignee: Harris Corporation, Melbourne, FL (US)

( * ) Notice: Subject to any disclaimer, the term of this patent is extended or adjusted under 35 U.S.C. 154(b) by 73 days.

(21) Appl. No.: 11/291,317

(22) Filed: Dec. 1, 2005

(65) Prior Publication Data

US 2007/0126651 A1 Jun. 7, 2007

(51) Int. Cl.
*H01Q 1/36* (2006.01)

(52) U.S. Cl. ..... 343/795; 343/793; 343/810

(58) Field of Classification Search ..... 343/795, 343/810

See application file for complete search history.

(56) References Cited

U.S. PATENT DOCUMENTS

| | | | | |
|---|---|---|---|---|
| 6,271,799 | B1 | 8/2001 | Rief et al. | 343/776 |
| 6,307,510 | B1 | 10/2001 | Taylor et al. | 343/700 |
| 6,417,813 | B1 | 7/2002 | Durham | 343/753 |
| 6,483,464 | B2 | 11/2002 | Rawnick et al. | 343/700 |
| 6,512,487 | B1 | 1/2003 | Taylor et al. | 343/795 |
| 6,717,549 | B2 | 4/2004 | Rawnick et al. | 343/700 |
| 6,822,616 | B2 | 11/2004 | Durham et al. | 343/700 |
| 6,856,297 | B1 | 2/2005 | Durham et al. | 343/795 |
| 6,876,336 | B2 | 4/2005 | Croswell et al. | 343/795 |
| 6,888,500 | B2 | 5/2005 | Brown et al. | 342/372 |
| 6,933,909 | B2 * | 8/2005 | Theobold | 343/893 |
| 7,034,749 | B2 * | 4/2006 | Leeper et al. | 343/700 MS |
| 2004/0104040 | A1 * | 6/2004 | Schauz | 174/250 |
| 2005/0030244 | A1 * | 2/2005 | Durham et al. | 343/795 |
| 2006/0097946 | A1 * | 5/2006 | McCarville et al. | 343/795 |
| 2006/0138922 | A1 * | 6/2006 | Kim et al. | 313/11 |

FOREIGN PATENT DOCUMENTS

| | | |
|---|---|---|
| WO | 01/97583 | 12/2001 |

OTHER PUBLICATIONS

Machac, et al., "*Wide-Slotted Printed Slotline Radiator*," Czech Technical University, 4 pages, no date.

* cited by examiner

*Primary Examiner*—Trinh V Dinh
(74) *Attorney, Agent, or Firm*—Allen, Dyer, Doppelt, Milbrath & Gilchrist, P.A.

(57) ABSTRACT

A dual polarization antenna includes a substantially pyramidal configured substrate having opposing walls. An antenna element is carried at each wall such that opposing pairs of antenna elements define respective antenna dipoles and provide dual polarization.

16 Claims, 8 Drawing Sheets

DUAL POLARIZATION ANTENNA AND ASSOCIATED METHODS

FIELD OF THE INVENTION

The present invention relates to the field of communications, and more particularly, to a dual polarization antenna element used in phased array antennas.

BACKGROUND OF THE INVENTION

Existing microwave antennas include a wide variety of configurations for various applications, such as satellite reception, remote broadcasting, or military communication. The desirable characteristics of low cost, lightweight, low profile form factors and mass producibility are provided in general by printed circuit antennas, wherein flat conductive elements are spaced from a single essentially continuous ground element by a dielectric sheet of uniform thickness. The antenna elements are designed in a periodic or a periodic array of like elements and may be used for communication systems such as Identification of Friend/Foe (IFF) systems, Personal Communications Service (PCS) systems, satellite communications systems, and aerospace systems, which require such characteristics as low cost, lightweight, and low profile form factor.

However, when wide bandwidth and high electronic scan angles are desired, these antennas may not meet stringent requirements on efficiency over octave plus or greater bandwidths. In such cases, the use of tightly coupled antenna arrays, typically using dipole type elements, can be used to increase bandwidth at the expense of efficiency over the full scan range. Since coupling changes substantially over wide bandwidths, maintaining efficiency at all desired scan angles may not be possible. Typically one would design the array elements such that maximum efficiency is achieved in the high scan region while sacrificing efficiency on bore sight Additionally, dipole antenna elements in such phased array applications require a set height above a ground plane. Therefore another possible drawback in some of these systems is the element-to-module interconnect, such as the feed network described in U.S. Pat. No. 6,483,464, that is essentially hand-made without using automated manufacturing techniques. Any handmade feed network would require many man-hours to build the thousands required for a large antenna array, thus the cost would typically be prohibitive.

Current state of the art dual polarized antenna arrays include proximity fed patch antenna arrays that can achieve as much as 30% bandwidth. These array elements are suited for automated manufacturing, but not for operating bandwidths much in excess of 30%. Some Visalia antenna arrays have bandwidths in excess of an octave, but suffer depth and integration issues for low profile electrically scanned antenna (ESA) applications. A noncontiguous ground plane is used in some of these antennas, making this type of antenna array difficult to adapt to automated manufacturing. Other dipole array antennas have acceptable bandwidth, but employ feed networks that are not suited for low cost automated manufacturing or applicable to pick-and-place and associated surface mount technology.

SUMMARY OF THE INVENTION

In one non-limiting aspect of the present invention, a dual polarization antenna includes a substantially pyramidal configured substrate having opposing walls. A monopole is carried at each wall such that opposing pairs define respective antenna dipoles and provide dual orthogonal polarization.

Each antenna element can be formed as a Molded Interconnect Device (MID). Diagonal feed sections can be defined by intersecting walls of the pyramidal configured substrate. A transmission line is carried at the feed sections and provides interconnect for each monopole. Opposing pairs of interconnects form a balanced dipole antenna feed. Each transmission line can include a launch formed at the feed sections. In one non-limiting example, the feed launch can be formed as an extension of an area of the pyramidal substrate forming a base at each feed section and configured for surface mounting to a printed circuit board. For example, the extension could be inwardly extending toward a medial portion of the pyramidal structure.

In yet another non-limiting aspect, the opposing walls taper no more than about 75%. The substantially pyramidal substrate can be formed as a molded material, such as an injection molded plastic material, which can be laser activated in selected areas for metallization such that the antenna elements are formed as metallized elements at the selected areas that have been laser activated.

A plurality of such dual polarization antenna elements can be arranged on a substrate comprising a ground plane and dielectric layer to form a phased array antenna. An antenna feed network can be formed in the substrate and interconnect the antenna elements on the substrate. A controller can be operative with the antenna feed network for controlling phase and gain.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

The dual polarization antenna element of the present invention is formed as a molded element, for example, a Molded Interconnect Device (MID), and replaces the typical feed network and aperture commonly used with dipole array antennas. The antenna element can be formed to adhere to basic antenna principals set forth in the article entitled, "Wide-Slotted Printed Slotline Radiator" by Jan Machac et al., the disclosure which is hereby incorporated by reference in its entirety. The antenna element, in accordance with one non-limiting example of the present invention, could be considered as two dipole wideband radiators wrapped about a pyramid shape. The dual polarization antenna element is, in one non-limiting example, an octave bandwidth array antenna element that is compatible with standard Surface Mount Technology (SMT) assembly techniques. It provides a low cost, low complexity and high performance antenna element that can be arranged as a plurality of elements on a substrate to form a phased array antenna. The antenna element provides dual linear polarization. Because Molded Interconnect Device (MID) technology is used, the antenna unit is low in cost and its design permits the manufacture of tightly coupled array elements that can take advantage of the standard surface mount technology.

The antenna element and its feed launch can be formed using Molded Interconnect Device (MID) technology, and assembled on a substrate using automated pick-and-place machines. A printed feed network as an antenna feed and feed launch is designed into the antenna element, eliminating the requirement for expensive and time-consuming coaxial systems. The antenna element of the present invention can be used in many applications that require low cost, high volume, wideband arrays using surface mount manufacturing techniques.

Figure 1:
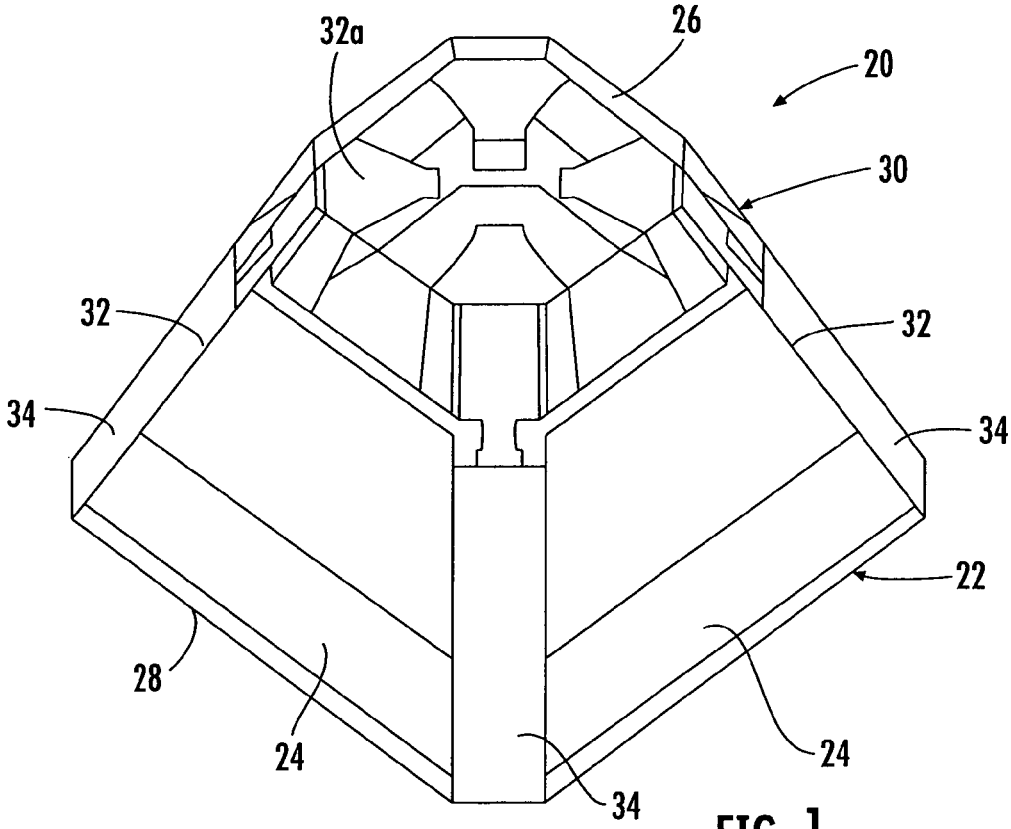
FIG. 1 is a perspective view of a dual polarization antenna element in accordance with one non-limiting example of the present invention.
Figure 2:
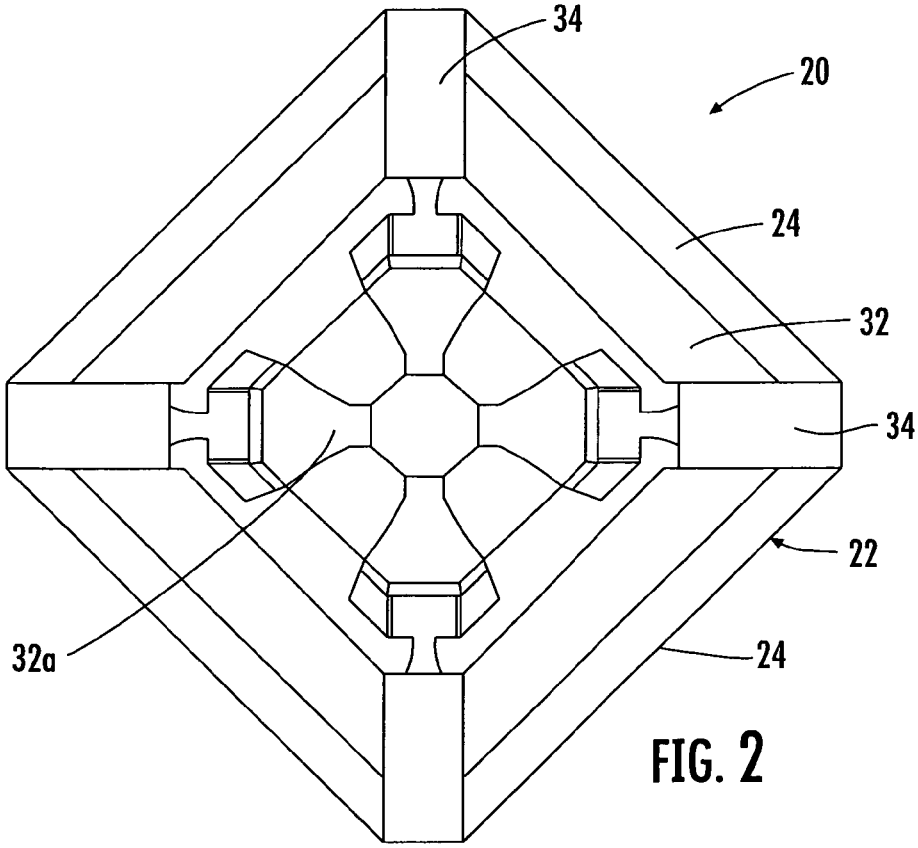
FIG. 2 is a top plan view of the antenna element shown in FIG. 1.
Figure 3:
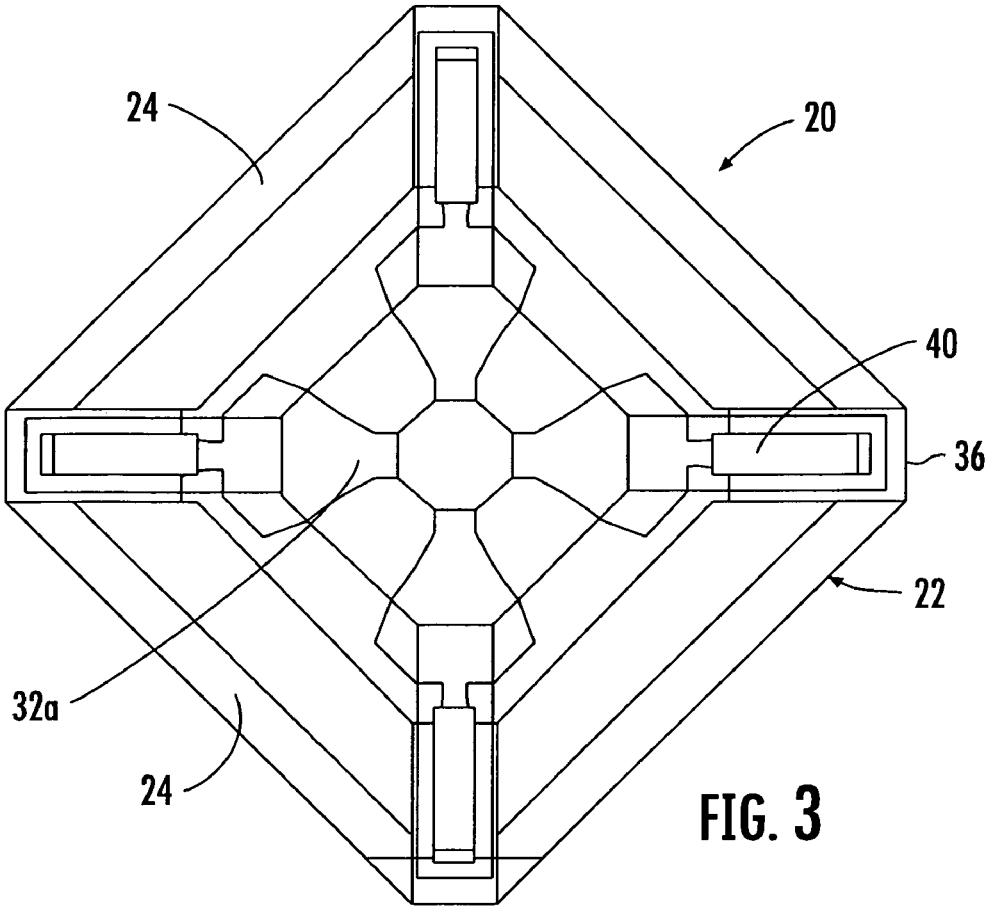
FIG. 3 is a bottom plan view of the antenna element shown in FIG. 1.
Figure 4:
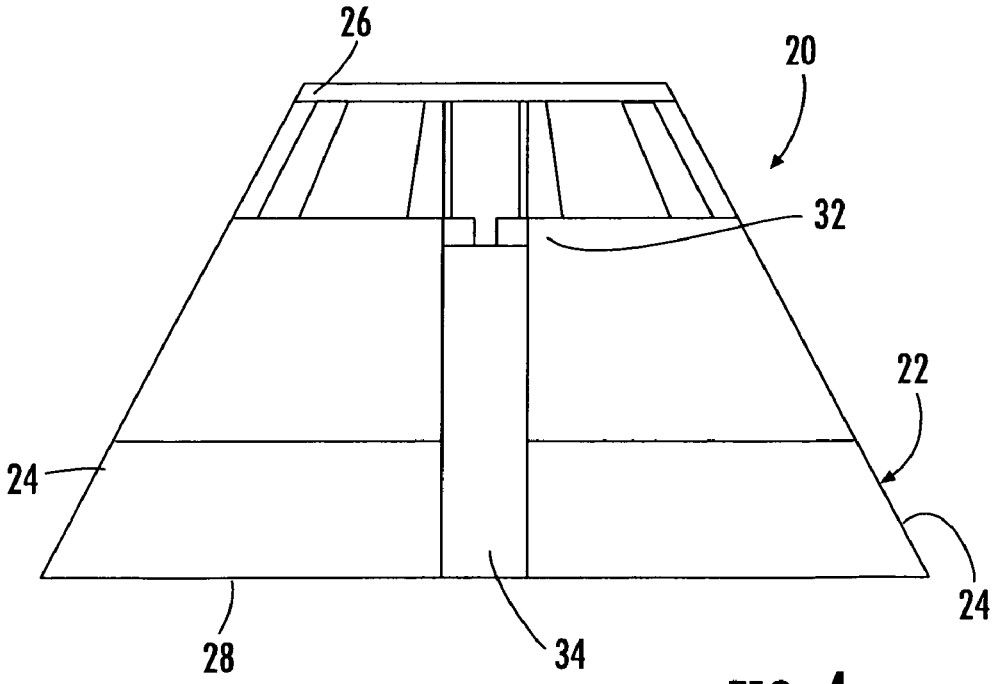
FIG. 4 is a side elevation view of the antenna element shown in FIG. 1.
Figure 5:
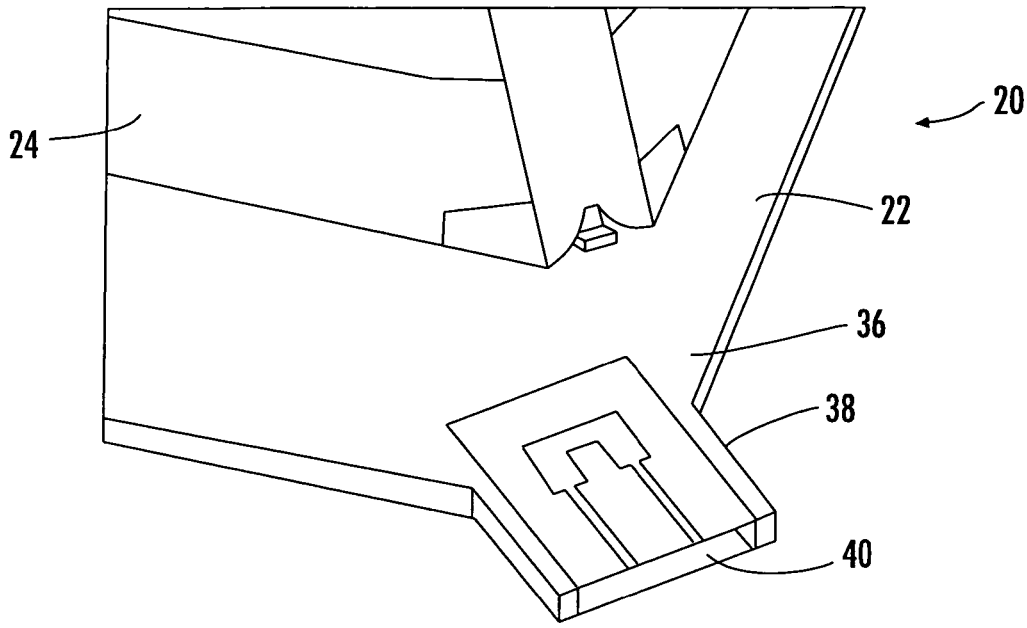
FIG. 5 is a fragmentary isometric view of the antenna element shown in FIG. 1 and looking from the side and showing in detail the feed launch.
Figure 6:
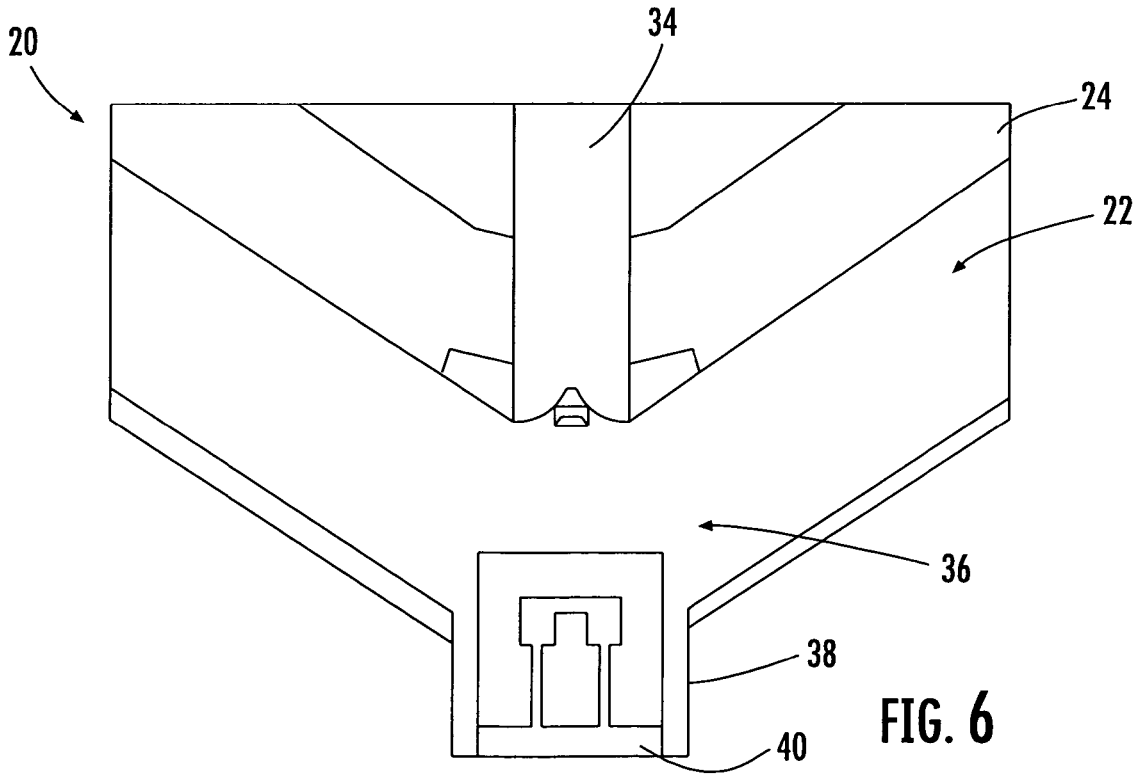
FIG. 6 is another fragmentary isometric view looking toward the front of the feed launch shown in FIG. 5.
Figure 7:
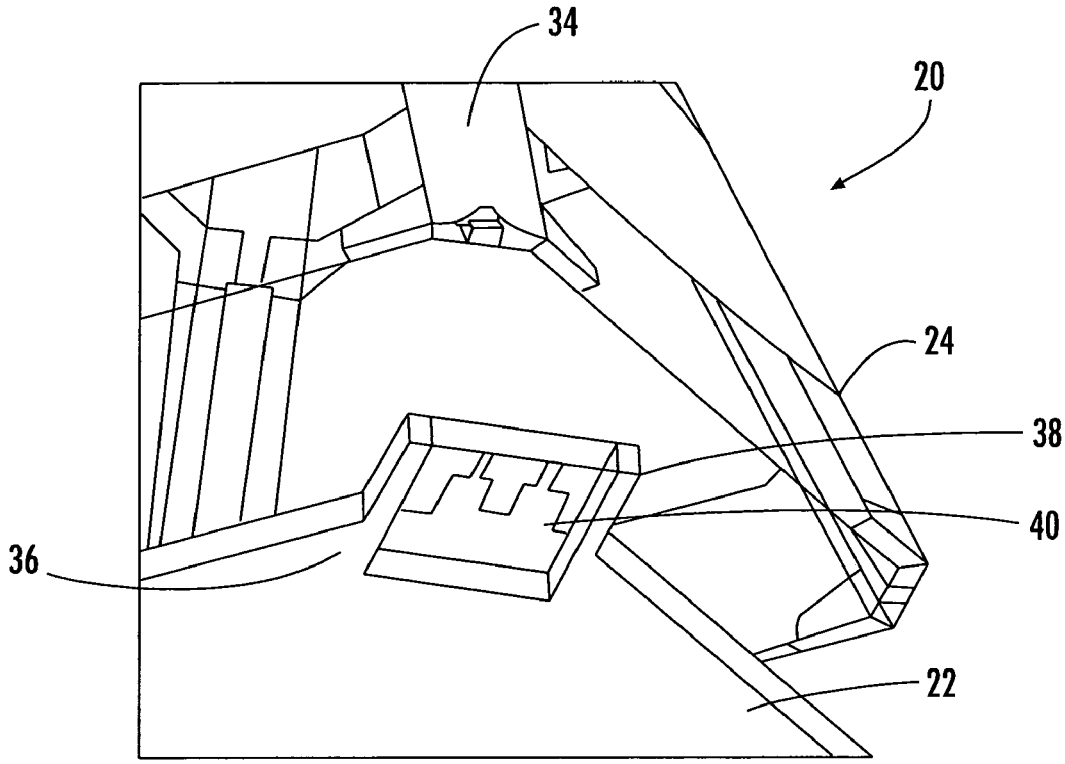
FIG. 7 is yet another fragmentary isometric view of the feed launch looking from the bottom.
Figure 8:
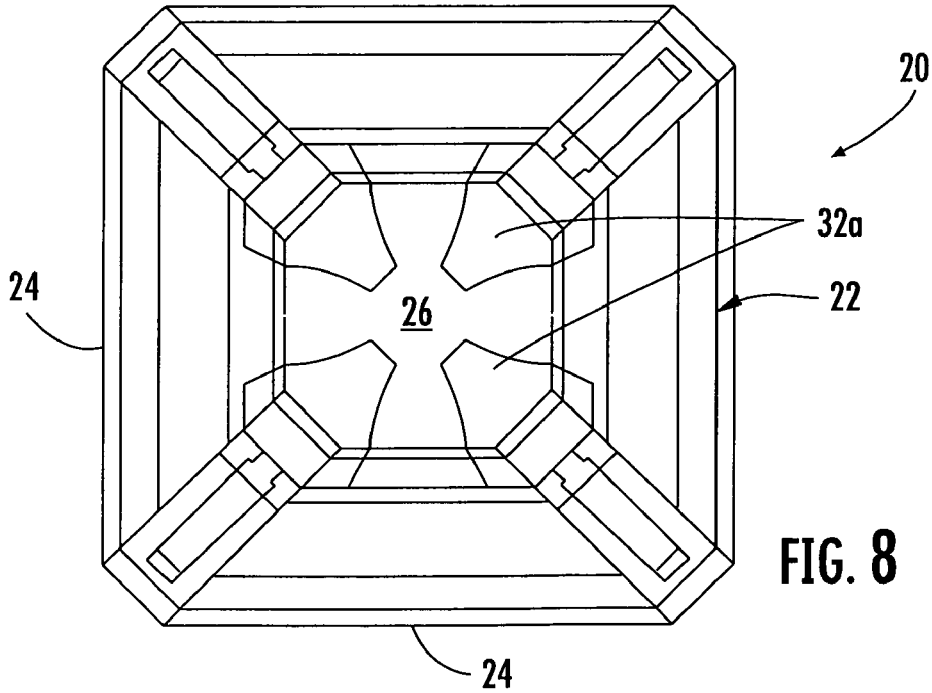
FIG. 8 is another top plan view of the antenna element similar to that shown in FIG. 2.

FIG. 1 is a perspective view of a dual polarization antenna element indicated generally at 20, in accordance with one non-limiting example of the present invention. As illustrated, the antenna element 20 includes a substantially pyramidal configured substrate 22 having two pair of opposing walls 24. The pyramid configured substrate is truncated at its top or apex to form a plane section 26 parallel to the pyramid base 28. The walls 24 are inclined toward each other and trapezoidal shaped, as illustrated. Four diagonal feed sections 30 are defined by intersecting walls and extend from the base to the plane section 26 at the apex in the form of a narrow, inclined and sloped surface.

The substantially pyramidal substrate 22 is formed from a material such as from a plastic injection molded material. As illustrated, a monopole 32 is carried at each wall 24. Opposing pairs of monopoles define respective antenna dipoles and provide dual polarization. As will be explained in further detail below, each monopole 32 carried by a respective wall 24 comprises a Molded Interconnect Device. Each transmission line 40 (FIG. 5) extends along its respective trapezoid shaped wall in a medial portion between the truncated apex and the base 28, and connects upward to the truncated apex of the pyramid at the upper area of the defined feed section such that dual linear polarization occurs across cell diagonals. At the apex, each monopole 32 at the diagonal feed section forms a horizontally oriented, tapered antenna element section 32*a*and together all four make a dual polarized antenna element. The diagonal feed sections 30 each include a transmission line 40 carried by the feed sections and interconnecting each monopole 32*a*with opposing pairs forming a balanced antenna feed. The antenna feed 34 extends upward to the tapered antenna element section 32*a*. A feed launch 36 is formed at the feed section, such as shown in FIGS. 2, and 5-7, and in one non-limiting example, is formed as a printed circuit board footprint 38 at an area of the pyramidal substrate forming the base at the feed section. The footprint 38 is configured for surface mounting to a board and includes respective contacts for surface mounting, such as formed by a 50 Ohm microstrip. The antenna feed 34 extends downward from the apex area along the feed section 30 toward the feed launch 36.

The antenna unit 20 and associated antenna elements, antenna feed and feed launches are formed with the pyramidal configured substrate 22 as a Molded Interconnect Device. Each antenna element 32 carried by a wall 24 could be formed by a metallization process. In accordance with those manufacturing techniques known for forming a Molded Interconnect Device, the pyramidal substrate 22 can be formed as an injection molded material using a plastic material that is laser activated in selected areas for metallization, such that the antenna elements are later formed by electroless plating at those laser activated selected areas.

It should be understood that the dual polarization antenna unit 20 can be formed by Molded Interconnect Device (MID) manufacturing techniques. For example, a Laser Direct Structure (LDS) process as established by LPKF Laser and Electronics can be used, requiring typically a 75 degree maximum slope inclination for vertical tracks. A precision metallization using a photolithographic process such as established by CyberShield, Inc. can also be used. Also, three-dimensional molded plated substrates (3DMPS) such as established by Apex can be used. In the example where the Molded Interconnect Device is formed by using a photo-imaging process, a trace mask is applied and a resist coating exposed to ultraviolet (UV) light to selectively harden any resist to non-circuit areas. The unexposed resist is chemically removed, revealing a circuit pattern. The pattern is plated with copper or other metals to achieve a desired circuit performance. A two-shot MID process can also be used in conjunction with an injection-molding process. A first-shot material and process would typically have a higher temperature than a second shot material and process. A second-shot plastic can use its shrink to form a tight bond. Additionally, flex foil insert molding can be used. Whereby a flexible substrate is patterned with photolithographic processes and placed into the tooling prior to injection molding.

In an LDS process, thermoplastics can be injection molded. Typically, the shaped parts to be laser structured are molded by using a one-component injection molding process in which dried and preheated plastic granules are injected into the mold. The injection-molded MID is ready for structuring with an industrial laser. It should be understood that the thermoplastic is laser-activatable such as by using an organic metal complex in the thermoplastic that is activated by a physico-chemical reaction from the laser beam. The complex compounds in the doped plastic are cracked open, and metal atoms from the organic ligands are broken off. These can act as a nuclei for a reductive copper coating. The laser also creates a microscopically irregular surface and ablates the polymer matrix, creating numerous microscopic pits and undercuts in which the copper can be anchored during metallization.

During the metallization process, current-free copper baths can be used with a deposit of about 3-5 micrometers an hour. Standard electro forming copper baths can also be used and application-specific coating such as Ni, Au, Sn, Sn/Pb, Ag, Ag/Pd and other coatings can be used.

Different materials can be used such as plastics Ultem 2100(polyetherimide, PEI), ER 3.5, Tan d 0.005; Dupont Kapton (polyimide), ER 3.4, Tan d 0.006; and Ticona Vectra (Liquid Crystal Polymer, LCP), ER various, Tan d various.

The laser direct structuring technology is able to produce about 150 micrometer (6 mil) tracks with about 200 micrometer (8 mil) gaps, in one non-limiting example. Slopes that are laser activated usually do not exceed a 75 degree incline because of manufacturing and laser capabilities, and holes or indentations can be tapered and have a cone angle of at least about 30 degrees to allow proper activation and plating. Holes and interconnects could be structured at the same time such as for allowing interconnection of outer and inner metallized areas of a device, such as the antenna unit.

The pyramidal configured substrate 22 in one non-limiting example can have a square lattice configuration of about 0.8 inches by about 0.8 inches, and overall part dimensions of about 0.76 by about 0.76 by about 0.55 inches, and a wall thickness of about 0.02 inches. The antenna feed at the feed launch is typically microstrip with about 50 Ohm ports. It should be understood that the individual antenna elements and antenna feeds can be formed on the inside surface or outside surface of the pyramid structure with interconnections extending through the substrate depending on the type of molding process used. Antenna elements on the walls can be separated from each other by small amounts of insulator material formed by the plastic and by molded techniques. The aperture formed by the tapering portions 32*a* of monopole elements 32 at the diagonal corners of the pyramid structure, together with the antenna feed 34, provide the appropriate dual polarization.

Figure 10:
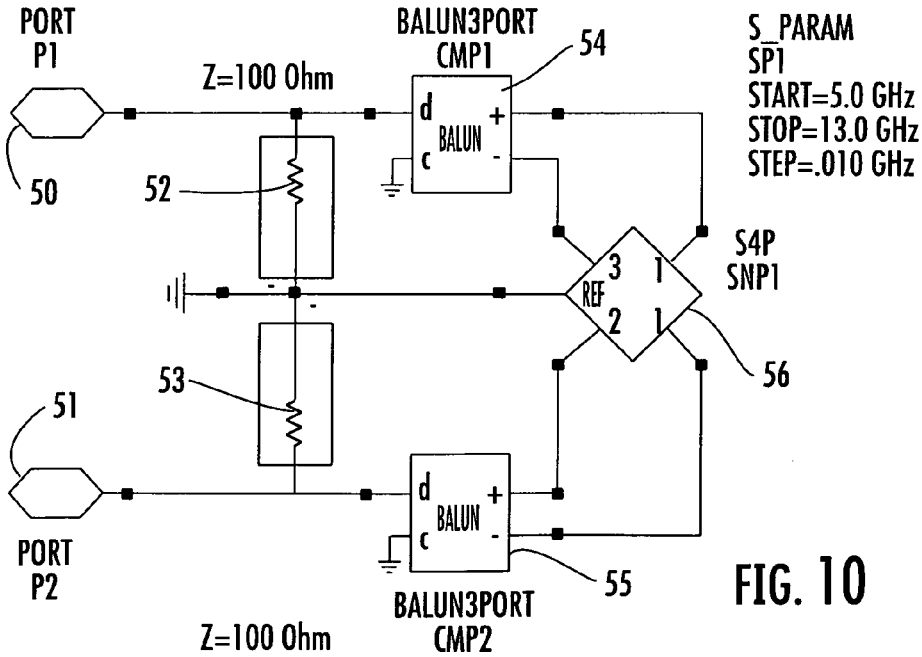
FIG. 10 is a schematic circuit diagram showing the type of circuit arrangement for a pyramidal crossed dipole arrangement that can be used for the antenna element shown in FIGS. 1-9.

FIG. 10 is a schematic circuit diagram of the type of balanced circuit that can be used to form a pyramidal cross dipole as shown in the figures. Port 1 and Port 2 50,51 are illustrated with their respective source impedances 52,53 and 1:1 baluns 54,55 connected to four element feeds shown generally at 56. Different parameters are shown. The 50 Ohm feeds are combined in the Advanced Design System (ADS) for Voltage Standing Wave Ratio (VSWR) performance.

Figure 9:
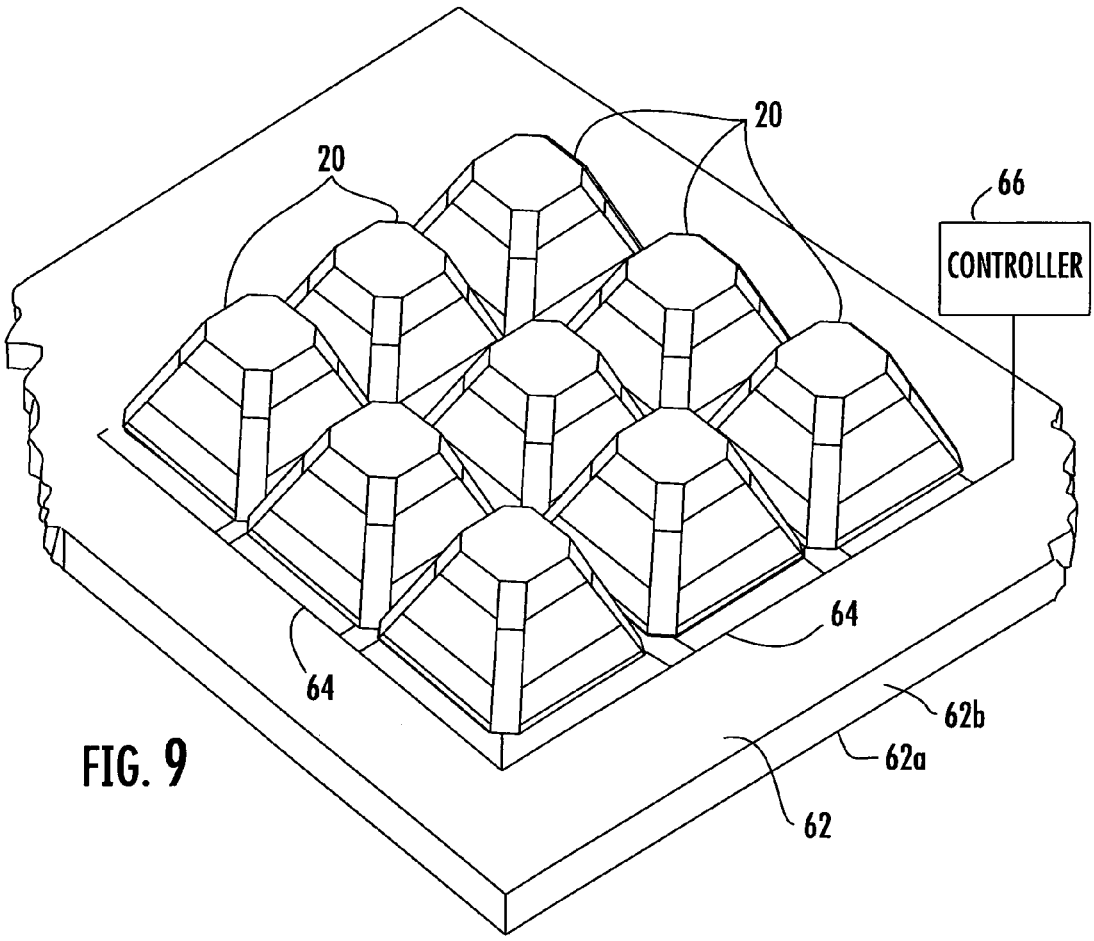
FIG. 9 is an isometric view of a phased array antenna that incorporates a plurality of antenna elements shown in FIG. 1.

FIG. 9 illustrates a phased array antenna 60 formed by a plurality of antenna elements 20 positioned in relatively close confines to each other on a substrate 62 that can be formed as a ground plane 62*a* and a dielectric layer 62*b* as typically known to those skilled in the art. The antenna units 20 can be interconnected by an antenna feed network 64 formed in the substrate and interconnecting antenna units on the substrate with a controller 66 for adjusting phase, angle and other functions to create the phased array antenna function.

Figure 11:
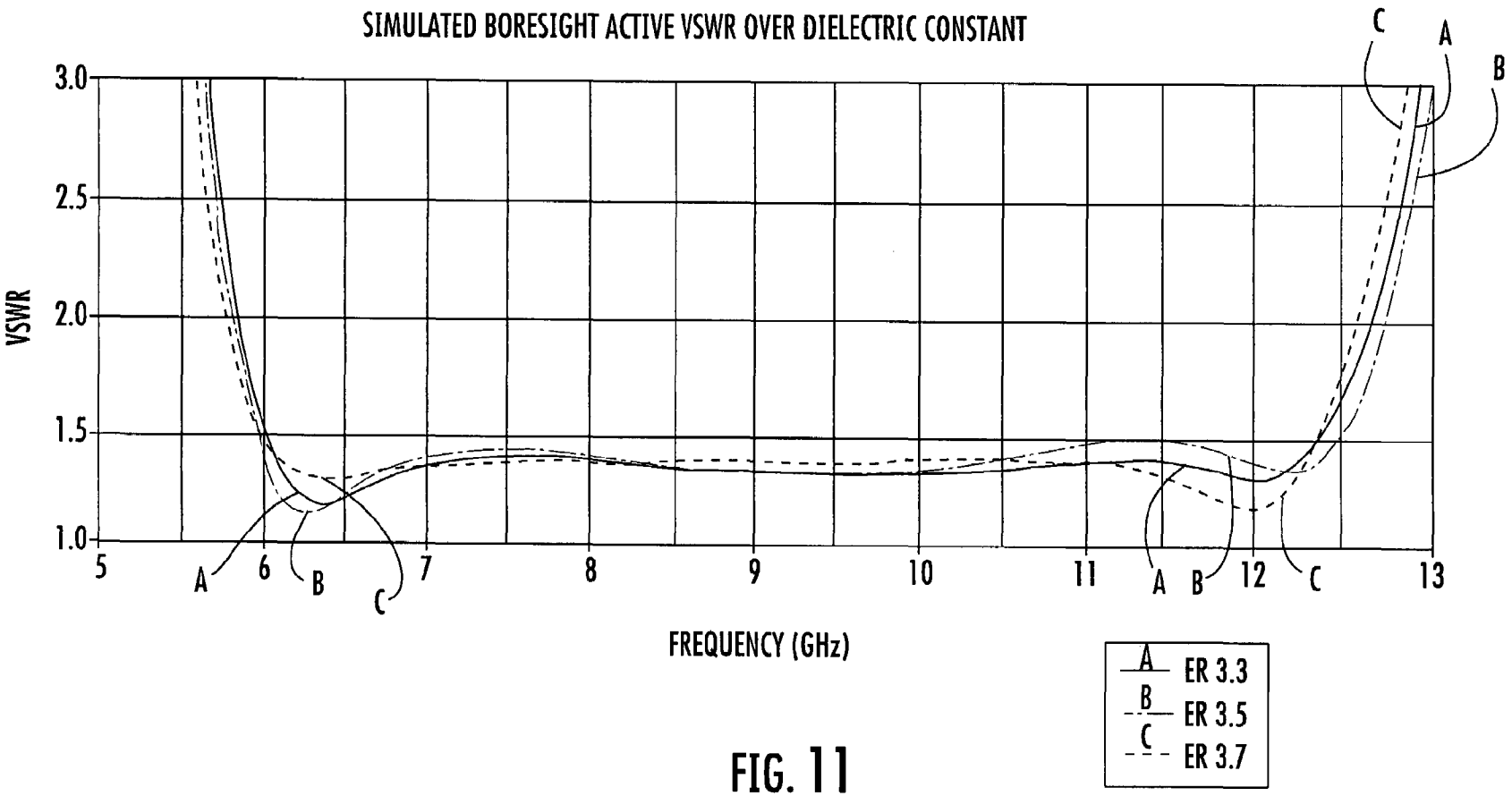
FIG. 11 is a graph showing the simulated boresight active Voltage Standing Wave Ratio (VSWR) over a dielectric constant and showing the VSWR versus frequency in GHz for an example antenna unit such as the type shown in FIG. 1.

FIG. 11 is a graph showing a simulated boresight active VSWR over a dielectric constant and showing VSWR on the vertical Y axis and the frequency in GHz on the horizontal X axis. The system is an octave impedance bandwidth. The system shows a relatively insensitivity to dielectric constant variation with the symmetry dictating both polarizations as somewhat identical.

Figure 12:
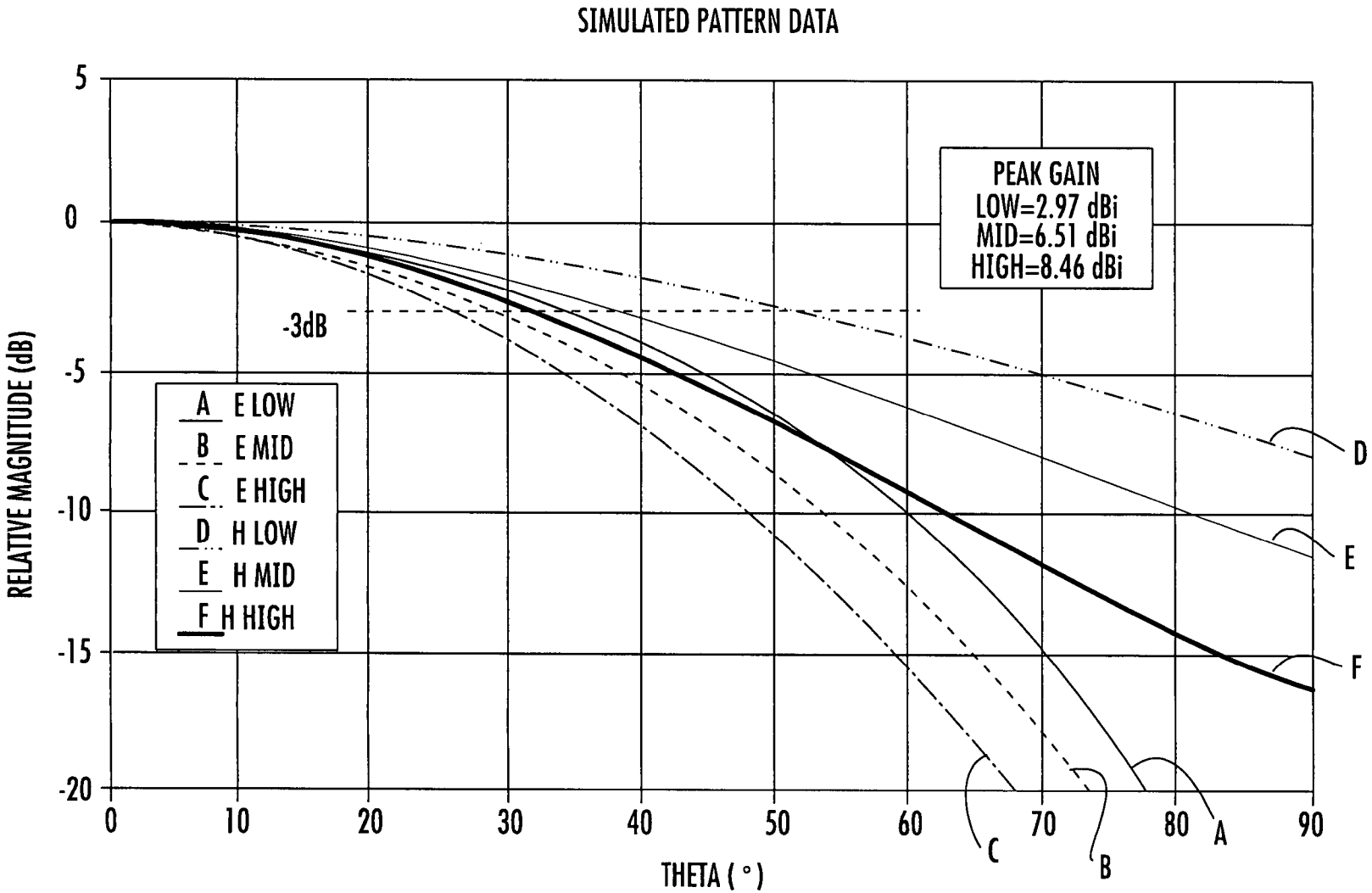
FIG. 12 is a graph showing simulated pattern data for an example antenna element such as the type shown in FIG. 1.
Figure 13:
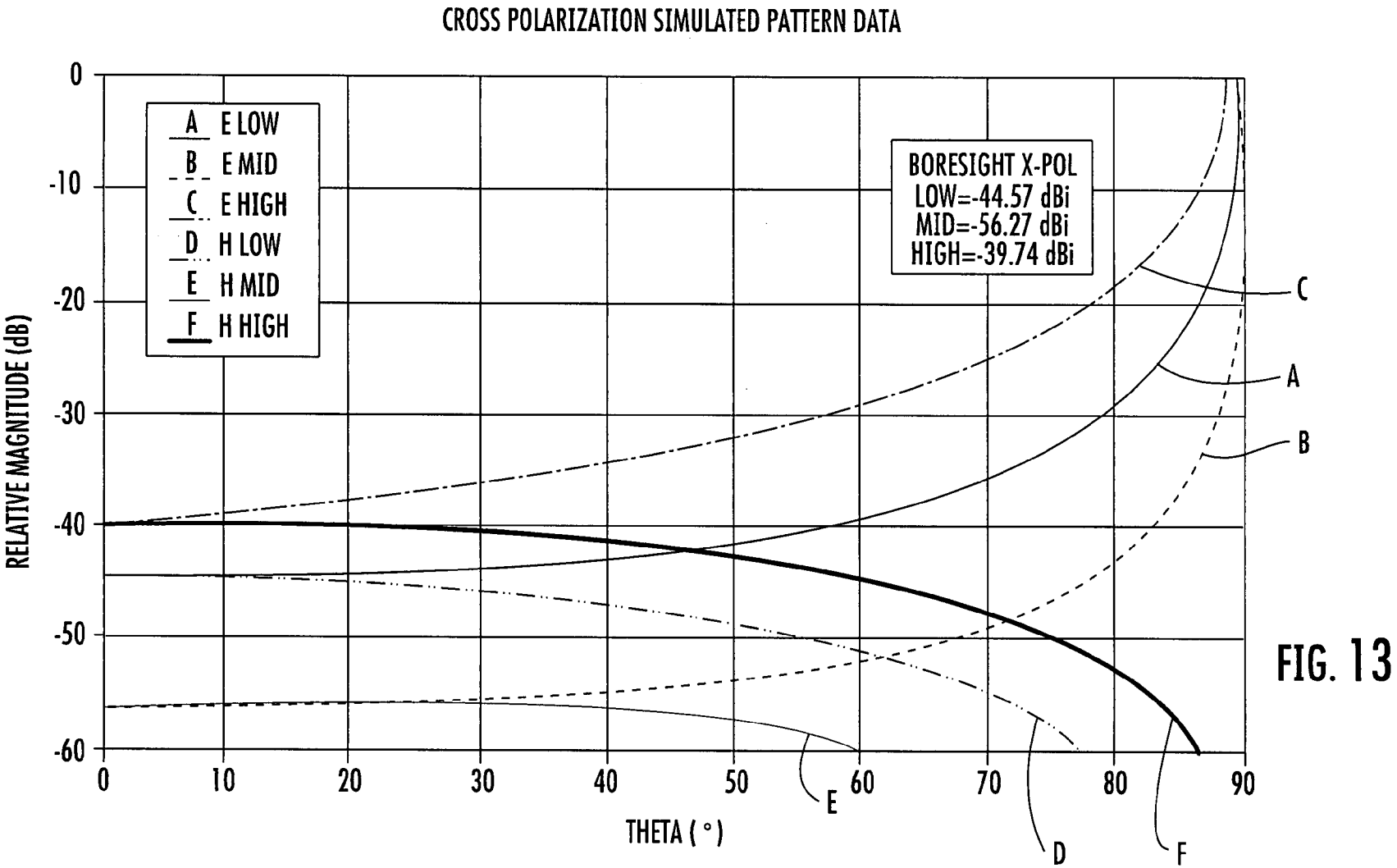
FIG. 13 is a graph showing cross polarization simulated pattern data for an example antenna element such as the type shown in FIG. 1.

FIG. 12 shows the simulated pattern data with a relative magnitude in decibels (dB) on the vertical Y axis and Theta in degrees on the horizontal X axis. FIG. 13 is a graph showing the cross polarization for simulated pattern data with the relative magnitude on the vertical Y axis and Theta on the horizontal X axis.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A dual polarization antenna element comprising:

a substantially pyramidal configured substrate having opposing and intersecting walls; and a monopole element carried at each wall such that opposing pairs of monopole elements define respective antenna dipoles and provide dual polarization, wherein said monopole elements are operative together as a balanced circuit, and further comprising diagonal feed sections defined by intersecting walls, and transmission lines carried by said feed sections and interconnecting each monopole element to form a dipole, and a feed launch formed at each feed section as an extension of the pyramidal substrate as a base configured to be surface mounted to a board.

2. A dual polarization antenna element according to claim 1, wherein each monopole element carried by the respective wall comprises a Molded Interconnect Device (MID).

3. A dual polarization antenna element according to claim 1, wherein said substantially pyramidal substrate comprises a molded material.

4. A dual polarization antenna element according to claim 1, wherein said pyramidal substrate comprises a plastic material that is laser activated in selected areas for metallization, and said monopole elements comprise of metallization applied at the selected areas that have been laser activated.

5. A dual polarization antenna element according to claim 1, wherein said monopole elements comprise metallized antenna structures.

6. A phased array antenna comprising:

a substrate comprising a ground plane and a dielectric layer adjacent thereto; and a plurality of dual polarization antenna elements carried by the substrate, each comprising a substantially pyramidal configured substrate having opposing and intersecting walls; and a monopole element carried at each wall such that opposing pairs of monopoles elements define respective antenna dipoles and provide dual polarization, wherein said monopole elements are operative together as a balanced circuit, and further comprising diagonal feed sections defined by intersecting walls, and transmission lines carried by said feed sections and interconnecting each monopole element to form a dipole, and a feed launch formed at each feed section as an extension of the pyramidal substrate as a base configured to be surface mounted to a board.

7. A phased array antenna according to claim 6, and further comprising an antenna feed network formed in the substrate and interconnecting antenna elements on the substrate.

8. A phased array antenna according to claim 6, wherein each monopole element carried by the respective wall comprises a Molded Interconnect Device (MID).

9. A phased array antenna according to claim 6, wherein said pyramidal substrate of each antenna element comprises a plastic material that is laser activated in selected areas for metallization, and said monopole elements comprise of metallization applied at the laser activated selected areas.

10. A phased array antenna according to claim 6, wherein monopole elements comprise metallized antenna structures.

11. A method of making a dual polarization antenna element, which comprises:

forming a substantially pyramidal configured substrate having opposing and intersecting walls;

forming a monopole element at each wall such that opposing pairs of monopole elements define respective antenna dipoles and provide dual polarization, such that monopole elements are operative together as a balanced circuit;

forming diagonal feed sections at intersecting walls and forming transmission lines at diagonal feed sections as a feed network; and forming a feed launch at feed sections as a footprint on the pyramidal substrate forming a base and configured for surface mounting to a board.

12. A method according to claim 11, which further comprises forming the pyramidal configured substrate by molding.

13. A method according to claim 11, which further comprises forming the monopole elements at each wall by metallization.

14. A dual polarization antenna element comprising:

a substantially pyramidal configured substrate having opposing and intersecting walls; and a monopole element carried at each wall such that opposing pairs of monopole elements define respective antenna dipoles and provide dual polarization;

diagonal feed sections defined by intersecting walls;

transmission lines carried by said feed sections and interconnecting each monopole element to forni a dipole; and a feed launch formed at the feed sections and comprising an extension at an area of the pyramidal substrate forming a base and configured for surface mounting to a board.

15. A phased array antenna comprising:

a substrate comprising a ground plane and a dielectric layer adjacent thereto; and a plurality of dual polarization antenna elements carried by the substrate, each comprising a substantially pyramidal configured substrate having opposing and intersecting walls; and a monopole element carried at each wall such that opposing pairs of monopoles elements define respective antenna dipoles and provide dual polarization, wherein each antenna element includes diagonal feed sections defined by intersecting walls;

transmission lines carried by said feed sections and interconnecting each monopole element to form a dipole; and a feed launch formed at feed sections and comprising an extension at an area of the pyramidal substrate forming a base and configured for surface mounting to a board.

16. A method of making a dual polarization antenna element, which comprises:

forming a substantially pyramidal configured substrate having opposing walls;

forming a monopole element at each wall such that opposing pairs of monopole elements define respective antenna dipoles and provide dual polarization;

forming diagonal feed sections at intersecting walls;

forming transmission lines at diagonal feed sections as a feed network; and forming a feed launch at feed sections as a footprint on the pyramidal substrate forming a base and configured for surface mounting to a board.

* * * * *